US010215502B2

(12) United States Patent
Kaiser et al.

(10) Patent No.: US 10,215,502 B2
(45) Date of Patent: Feb. 26, 2019

(54) HEAT EXCHANGER

(71) Applicant: Mahle International GmbH, Stuttgart (DE)

(72) Inventors: Juergen Kaiser, Ditzingen (DE); Boris Kerler, Stuttgart (DE); Alexander Meiser, Stuttgart (DE); Wael Nassar, Stuttgart (DE); Martin Paarmann, Stuttgart (DE)

(73) Assignee: Mahle International GmbH (DE)

( * ) Notice: Subject to any disclaimer, the term of this patent is extended or adjusted under 35 U.S.C. 154(b) by 282 days.

(21) Appl. No.: 14/437,496

(22) PCT Filed: Oct. 21, 2013

(86) PCT No.: PCT/EP2013/071943
§ 371 (c)(1),
(2) Date: Apr. 21, 2015

(87) PCT Pub. No.: WO2014/064036
PCT Pub. Date: May 1, 2014

(65) Prior Publication Data

US 2015/0292813 A1 Oct. 15, 2015

(30) Foreign Application Priority Data

Oct. 22, 2012 (DE) ..... 10 2012 219 268

(51) Int. Cl.
*F28F 1/10* (2006.01)
*F28D 1/053* (2006.01)
(Continued)

(52) U.S. Cl.
CPC ..... *F28F 1/10* (2013.01); *F28F 9/0224* (2013.01); *F28F 9/182* (2013.01); *F02B 29/045* (2013.01); *F28D 1/05366* (2013.01)

(58) Field of Classification Search
CPC .. F28F 9/182; F28F 9/0224; F28F 9/02; F28F 1/10; F28F 9/04; F28F 1/32; F28D 1/05366; F02B 29/045
See application file for complete search history.

(56) References Cited

U.S. PATENT DOCUMENTS 5,092,397 A * 3/1992 Fuhrmann ..... F28F 1/32 165/151
2007/0186575 A1 8/2007 Heuss et al.
2014/0054018 A1* 2/2014 Augenstein ..... F02B 29/045 165/173

FOREIGN PATENT DOCUMENTS

DE 3910357 A1 10/1990
DE 102011075071 A1 * 11/2012 ..... F02B 29/045
(Continued)

OTHER PUBLICATIONS

English abstract for JP-11051592.
Search Report for DE-102012219268.9, dated Sep. 4, 2013.

*Primary Examiner* — Jon T. Schermerhorn, Jr.
(74) *Attorney, Agent, or Firm* — Fishman Stewart PLLC

(57) ABSTRACT

A heat exchanger may include a block for separately conducting first and second fluids, and a box. The block may have flat tubes through which the first fluid is flowable and each of which may have a narrow tube side and a wide tube side. The box may have a base, the flat tubes being guided into the base via corresponding through-openings in the base. Each through-opening may have at least one raised edge, with at least one narrow edge side and at least one wide edge side, surrounding the corresponding flat tube. The wide edge side may be higher than the narrow edge side. The two may transition into one another via an inclination with a recess that may have a height lower than that of the narrow edge side. A contact surface edge may have a height lower at the recess than at the narrow edge side.

4 Claims, 2 Drawing Sheets

(51) Int. Cl.

| | |
|---|---|
| ***F28F 9/02*** | (2006.01) |
| ***F28F 9/18*** | (2006.01) |
| *F02B 29/04* | (2006.01) |

(56) References Cited

FOREIGN PATENT DOCUMENTS

| | | | |
|---|---|---|---|
| DE | 102011075071 | A1 | 11/2012 |
| JP | 11051592 | | 8/1997 |
| WO | WO-2008/071362 | A1 | 6/2008 |
| WO | WO-2011/042491 | A1 | 4/2011 |
| WO | WO-2012/150237 | A1 | 11/2012 |

* cited by examiner

HEAT EXCHANGER

CROSS-REFERENCE TO RELATED APPLICATIONS

This application claims priority to German Patent Application No. 10 2012 219 268.9, filed Oct. 22, 2012, and International Patent Application No. PCT/EP2013/071943, filed Oct. 21, 2013, both of which are hereby incorporated by reference in their entirety.

TECHNICAL FIELD

The present invention relates to a heat exchanger for exchanging heat between a first fluid and a second fluid. The invention furthermore relates to a base for such a heat exchanger.

BACKGROUND

From WO 2008/071362 A1 a generic heat exchanger, for example in the manner of a cooler, is known, comprising a block for conducting the two fluids separately and so as to exchange heat, said block having a number of flat tubes through which the first fluid flows and which comprise a narrow tube side and a wide tube side. The flat tubes terminate respectively on the longitudinal end side in a base of a box, wherein the flat tubes are guided into the box via corresponding through-openings in the base. Each of the through-openings in the base has here a raised edge which surrounds the corresponding flat tube, wherein the wide edge sides are usually higher than the narrow edge sides and transition into one another via a corresponding inclination.

A disadvantage in the known heat exchanger, however, is that owing to the high temperature differences, stresses occur in the region of the inclination between the wide edge side and the narrow edge side on the base of the heat exchanger, which have a disadvantageous effect on the service life of the heat exchanger.

SUMMARY

The present invention is therefore concerned with the problem of indicating for a heat exchanger of the generic type an improved embodiment which is distinguished in particular by a longer service life.

This problem is solved according to the invention by the subjects of the independent claims. Advantageous embodiments are the subject of the dependent claims.

The present invention is based on the general idea of providing, in the region of an inclination, via which a wide edge side transitions into a low narrow edge side, an in particular rounded out recess, the height of which is lower than that of the narrow edge side, wherein the stresses in the region of the corners of the flat tubes, which are bordered by the respective edge of the through-opening, can be reduced by approximately 14% and the service life can be increased by approximately 50%. Generally here the heat exchanger according to the invention is constructed as follows: It has a block for the separate and heat-exchanging directing of a first and a second fluid, wherein this block has a number of flat tubes, flowed through by the first fluid, with a narrow edge side and with a wide edge side. The flat tubes are introduced here via corresponding through-openings in a base into a box and connected fluidically therewith. Each of these through-openings has a raised edge surrounding the associated flat tube, wherein the wide edge sides of this edge are higher than the narrow edge sides and transition into one another via a corresponding inclination. According to the invention, in the region of this inclination, in particular in a corner region, the recess is now provided, the height of which is lower than that of the narrow edge side and which leads to the previously described stress reduction. In addition, a contact surface edge of a contact surface between the edge and the flat tube in the region of the recess has a smaller height than in the region of the narrow edge side. This contributes substantially to reducing the stresses occurring in the corner region of the flat tube. The provision of this recess has led in a surprising manner to a distinct decrease in the stress and hence to a distinct increase in the service life of the heat exchanger.

Expediently, the height of the in particular rounded out recess corresponds to approximately half the height of the wide edge side. By variation of the heights of the recesses, it was able to be established that the reduction of the stress in the corners of the flat tubes was greatest when the height of the recess corresponded to approximately half the height of the wide edge side. The variation of the height was carried out here after the surprising discovery of the effect of the recess according to the invention. The recess can present here both a rounded, angled and a tapering geometry.

The height of the wide edge side can be, for example, approximately 7 mm, wherein then the height of the recess is approximately 3.5 mm. This data is conceivable in particular for current heat exchangers such as are used for example as coolers in motor vehicles.

Further important features and advantages of the invention will emerge from the subclaims, from the drawings and from the associated figure description with the aid of the drawings.

It shall be understood that the features mentioned above and to be further explained below are able to be used not only in the respectively indicated combination, but also in other combinations or in isolation, without departing from the scope of the present invention.

Preferred example embodiments of the invention are illustrated in the drawings and are explained in further detail in the following description, wherein the same reference numbers refer to identical or similar or functionally identical components.

BRIEF DESCRIPTION OF THE DRAWINGS

There are shown here, respectively diagrammatically.

DETAILED DESCRIPTION

Figure 1:
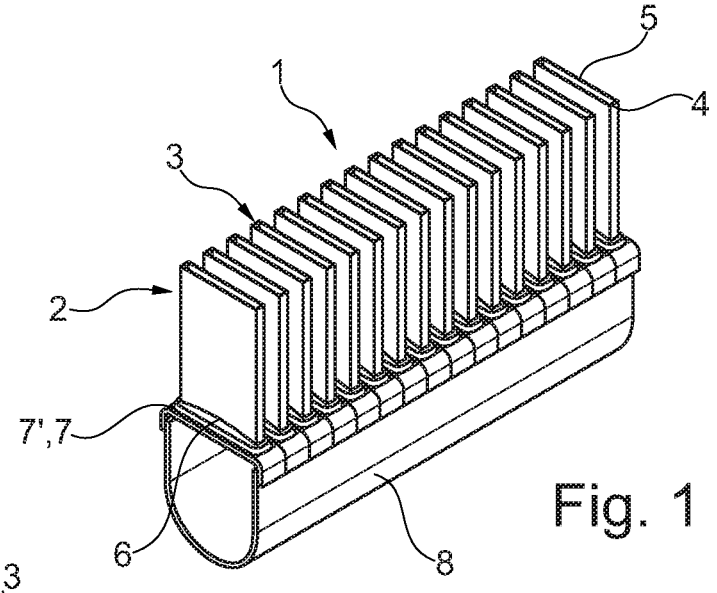
FIG. 1 a cutout of a heat exchanger according to the invention.

According to FIG. 1, a heat exchanger 1 according to the invention for exchanging heat between a first and a second fluid, for example for exchanging heat between air and coolant, has a block 2 for conducting the two fluids separately and so as to exchange heat, said block having a number of flat tubes 3 through which the first fluid flows and which comprise a narrow tube side 4 and a wide tube side 5. The flat tubes 3 are guided into a box 8 via corresponding through-openings 6 (cf. also FIGS. 2 and 3) in a base 7 and are thereby fluidically connected therewith. Each of the through-openings 6 has a raised edge 9 which surrounds the corresponding flat tube 3, wherein the wide edge sides 10 are higher than the narrow edge sides 11 and transition into one another via a corresponding inclination 12 (cf. in particular FIG. 3). According to the invention, in the region of this inclination 12 a rounded out recess 13 is now provided, the height $h_1$ of which is lower than the height $h_2$ of the narrow edge side 11 and of course also lower than the height $h_3$ of the wide edge side 10. Through the rounded out recess 13 a stress in a flat tube 3 surrounded by the edge 9 can be distinctly reduced, for example by 14%, whereby the service life of the heat exchanger 1 can be increased by almost 50%.

The height $h_1$ of the rounded out recess 13 corresponds here preferably to approximately half the height $h_3$ of the wide edge side, so that for example with a height $h_3$ of approximately 7 mm, the height $h_1$ of the recess 13 is approximately 3.5 mm. As can be seen in particular from the detail illustrations in FIGS. 2 and 3, the recess 13 lies directly against the narrow edge side 11 and then transitions via the inclination 12 into the wide edge side 10.

Figure 2:
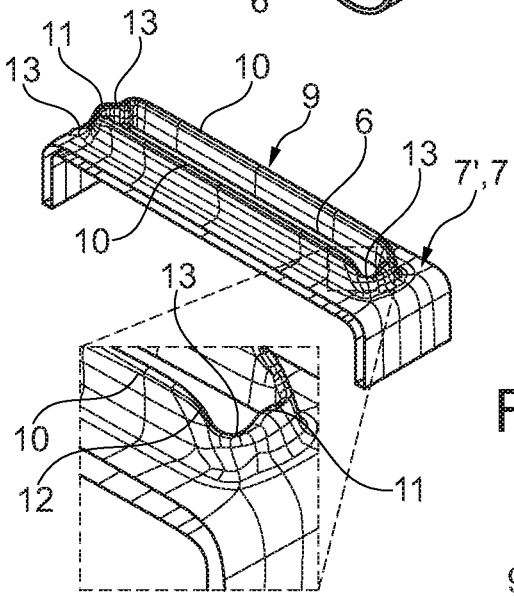
FIG. 2 a detail illustration of a base of the heat exchanger with a recess arranged in the region of an inclination of an edge, FIG. 3 an illustration as in FIG. 2, but from a different perspective, FIG. 4*a* a detail illustration of a base of a heat exchanger according to the prior art with an outwardly bent edge on the narrow edge side and with a contact surface edge, drawn in broken lines, between base and flat tube, FIG. 4*b* a flat tube with a contact surface edge, drawn in broken lines, to a base according to the prior art, FIG. 5*a* an illustration as in FIG. 4*a*, but with a heat exchanger/base according to the invention, FIG. 5*b* an illustration as in FIG. 4*b*, but with a contact surface edge, drawn in broken lines, in a heat exchanger/base according to the invention.
Figure 3:
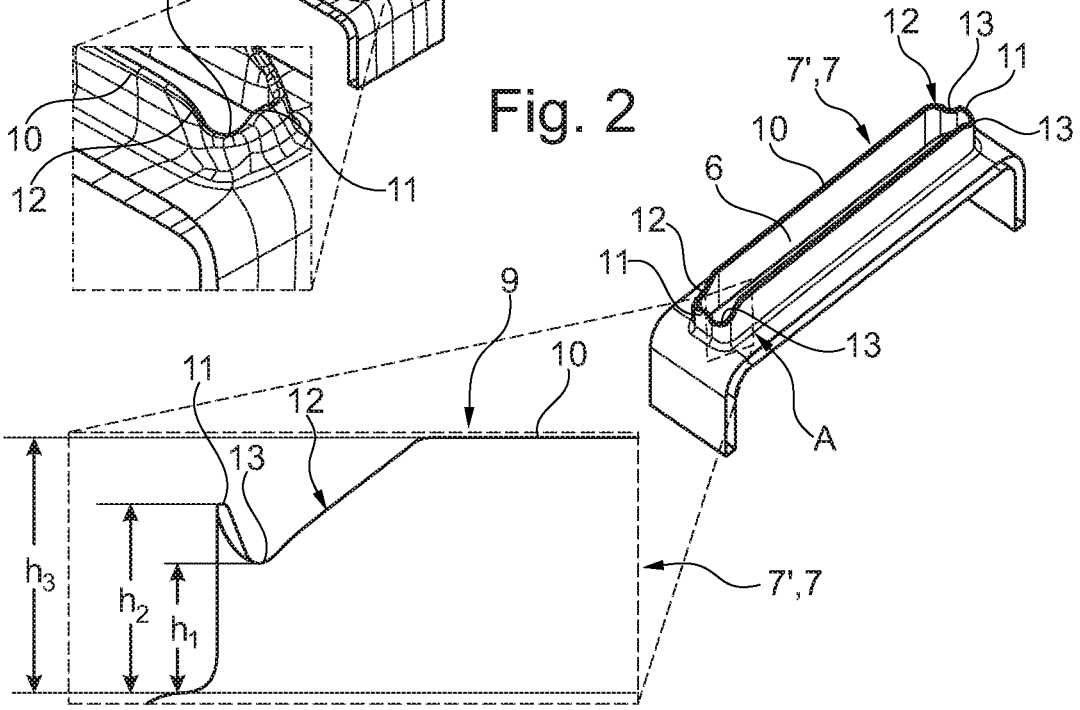

However, protection is not only to be requested here exclusively for the heat exchanger 1 according to the invention, but additionally also for the base 7, as it is illustrated as an individual segment for example in FIGS. 2 and 3. A base 7 of almost any desired length can thus be composed from such individual segments. Such a base 7, i.e. such a base element 7', has a through-opening 6 with a raised edge 9 surrounding it, wherein the wide edge sides 10 are higher than the narrow edge sides 11 and transition into one another via a corresponding inclination 12. Each of the base elements 7' has here in the region of the inclination 12 the previously mentioned rounded out recess 13, the height $h_1$ of which is lower than the height $h_2$ of the narrow edge side. In total, four recesses 13 are thus provided on the circumferential edge 9 for each base element 7' or respectively for each base 7. The base 7 or respectively the associated base element 7' can be constructed for example as a sheet metal shaped part.

With the recess 13 according to the invention, it is possible to distinctly reduce the stress acting in particular on the flat tubes 3, and thereby to distinctly increase the service life of the heat exchanger 1.

Figure 4A:
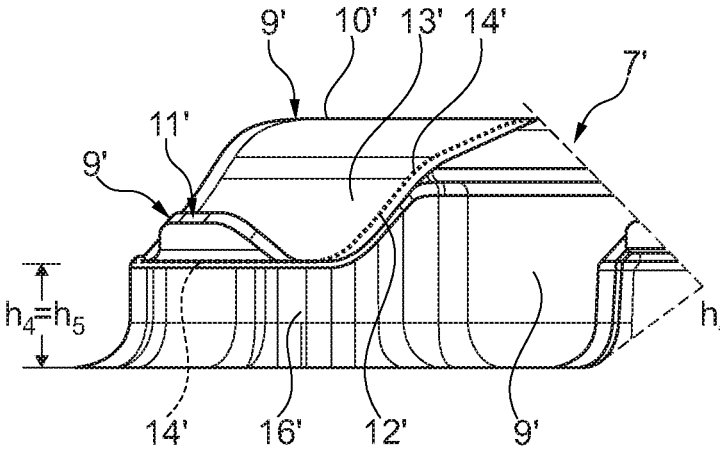
Fig. 4A Prior Art
Figure 4B:
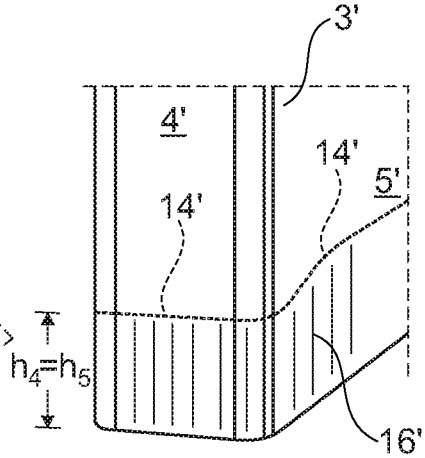
Fig. 4B Prior Art
Figure 5A:
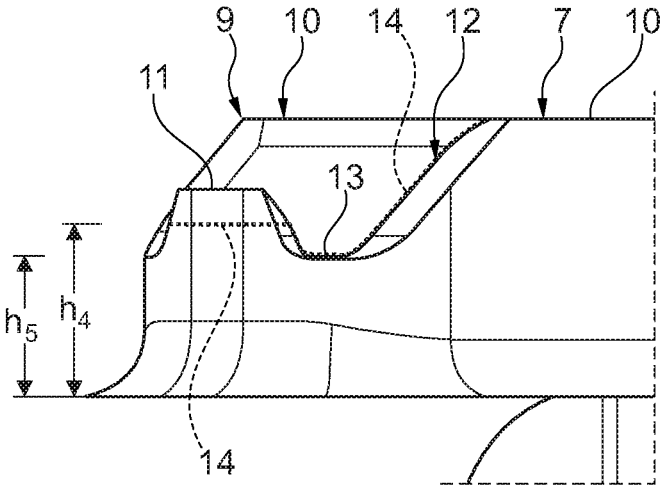
Figure 5B:
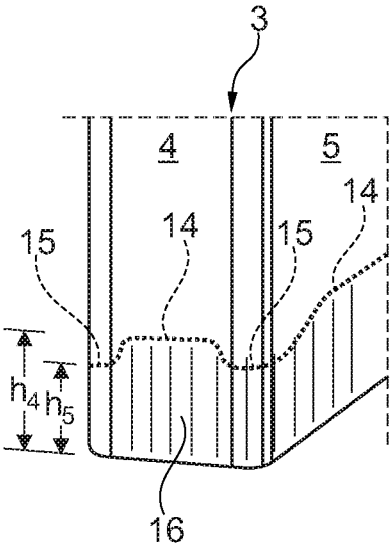

Observing FIGS. 4*a* and 4*b*, a heat exchanger 1' according to the prior art is shown there, for example according to DE 10 2011 075 071 A1, in which the edge 9' is bent outwards on the narrow edge side 11'. This leads to a contact surface edge 14' between the edge 9' and the flat tube 3' on the narrow edge side 11' running at the same height h, as in the region of the rounded out recess 13', as is illustrated clearly in FIG. 4*b*. The contact surface edge 14' is drawn here in broken lines and constitutes an edge of a contact surface 16' between the edge 9' and the flat tube 3'. The height $h_4$ of the contact surface edge 14 in the region of the narrow edge side 11' therefore corresponds to the height $h_5$ of the contact surface edge 14' in the region of the recess 13'.

On the other hand, in the heat exchanger 1 according to the invention, in accordance with FIGS. 1 to 3 and 5, the contact surface edge 14 in the region of the recess 13 also has, in an analogous manner thereto, a rounding-out 15, which contributes substantially to reducing stresses occurring in the corner region of the flat tube 3. This is shown very clearly in FIG. 5*b*, but also in FIG. 5*a*. It can be clearly seen that the contact surface edge 14 in the region of the recess 13 runs beneath the contact surface edge 14 in the region of the narrow edge side 11. The contact surface 16 is recessed accordingly in the region of the recess 13. The contact surface edge 14 therefore has in the region of the recess 13 a lower height $h_5$ than in the region of the narrow edge side 11, i.e. the height $h_4$ of the contact surface edge 14 in the region of the narrow edge side 11 is greater than in the region of the recess 13.

The height $h_4$ of the contact surface edge 14 is, in addition, lower in the region of the narrow edge side 11 than the height $h_3$ of the edge 9 in the region of the wide edge side 10. The same also applies to the height $h_5$ of the contact surface edge 14 in the region of the recess 13.

For the further relief of the flat tube 3, the edge 9 in the corner region, i.e. in the region of the recess 13, can have a reduced wall thickness.

The invention claimed is:

1. A heat exchanger for exchanging heat between a first fluid and a second fluid, comprising:

a plurality of spaced apart flat tubes through which the first fluid flows, each of said flat tubes comprises two narrow tube sides and two wide tube sides;

a box having a base provided with a number of through-openings structured and arranged to receive said flat tubes such that each of said flat tubes is guided into the box via a corresponding through-opening of said through-openings;

said through-openings each having a raised edge that surrounds the corresponding flat tube, the raised edge including two narrow edge sides and two wide edge sides;

wherein each of the narrow edge sides is located between the two wide edge sides and each of the wide edge sides is located between the two narrow edge sides, and the raised edge includes a rounded corner portion located between each of the narrow and wide edge sides;

wherein a height of the wide edge sides is greater than a height of the narrow edge sides, and the height of the narrow edge sides is greater than a height of the corner portion;

wherein the raised edge is directly connected to the corresponding flat tube to define a continuous contact surface around the flat tube, the contact surface being the area of contact between the raised edge and the corresponding flat tube; and wherein a height of the contact surface at the wide edge sides is greater than a height of the contact surface at the narrow edge sides, and the height of the contact surface at the narrow edge sides is greater than a height of the contact surface at the corner portion.

2. The heat exchanger according to claim 1, wherein the height of the corner portion is half of the height of the wide edge sides.

3. The heat exchanger according to claim 1, wherein at least one of: the height of the wide edge sides is 7 mm, and the height of the corner portion is 3.5 mm.

4. The heat exchanger according to claim 1, wherein the raised edge has a reduced wall thickness at the corner portion.

* * * * *